US008235744B1

(12) United States Patent
Liptak et al.

(10) Patent No.: US 8,235,744 B1
(45) Date of Patent: Aug. 7, 2012

(54) ELECTRICAL CONNECTION SYSTEM INCLUDING CONNECTOR BODY WITH INTEGRAL PRIMARY AND SECONDARY LATCH

(75) Inventors: Nicole L. Liptak, Cortland, OH (US); Leslie L. Jones, Garrettsville, OH (US); James D. Daugherty, Brookfield, OH (US); Terry A. George, Salem, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 13/018,841

(22) Filed: Feb. 1, 2011

(51) Int. Cl.
*H01R 13/627* (2006.01)

(52) U.S. Cl. ..... 439/352

(58) Field of Classification Search ..... 439/352, 439/357, 358
See application file for complete search history.

(56) References Cited

U.S. PATENT DOCUMENTS 5,651,689 A * 7/1997 Plyler et al. ..... 439/352
6,234,826 B1 * 5/2001 Wilber et al. ..... 439/352

OTHER PUBLICATIONS

Tyco Electronics, HVA280-2phi High-Voltage Plug Connector, Instruction Sheet, 408-10299, Jul. 13, 2009. Rev A, pp. 1-6.
Tyco Electronics, HVA280 Header Sealed 2-Position High-Voltage Connection System with HVIL, Instruction Sheet, 408-10294, Apr. 16, 2009. Rev A, pp. 1-5.
Tyco Electronics, Product Drawing, dated Jan. 31, 2011, 1 sheet.
Tyco Electronics, Appendix, two pages, undated.

* cited by examiner

*Primary Examiner* — Javaid Nasri
(74) *Attorney, Agent, or Firm* — Paul W. Thiede

(57) ABSTRACT

A first connector is matable to a second connector in an electrical connection system. The first connector has a connector body that contains a primary and a secondary latch. The respective latches and the connector body of the first connector are molded to form a single unitary piece. The single unitary piece is constructed to define a space intermediate the primary latch and the connector body. The space is adapted to fit a latch position assurance lock to prevent displacement of the primary latch. The primary and the secondary latch respectively communicate with at least one primary and at least one secondary latch ramp disposed on the second connector when at least the first connector is unmated from the second connector. A method to assemble an electrical connection system using the single unitary piece of the first connector is also provided.

21 Claims, 14 Drawing Sheets

ELECTRICAL CONNECTION SYSTEM INCLUDING CONNECTOR BODY WITH INTEGRAL PRIMARY AND SECONDARY LATCH

TECHNICAL FIELD

This invention relates to an electrical connection system that includes a latch position assurance lock.

BACKGROUND OF INVENTION

It is known to transmit high-power electrical signals in a vehicular environment through electrical power connection assemblies.

For example, these electrical power connection assemblies may be used in 42 $V_{DC}$ electrical systems or in high-voltage electrical systems found in hybrid electric or electric vehicles. One such electrical power connection assembly is partially unmated and then completely unmated so as to prevent undesired electrical arcing of power electrical signals between electrical connections disposed in the electrical power connection assembly when the electrical power connection assembly is unmated. And because these power electrical connection assemblies carry high-voltage electrical power signals, the desire remains to unmate these electrical power connection assemblies without having power electrical signals being electrically transmitted through the power connection assembly to provide safety to individuals that need to access these connection assemblies during vehicle assembly or other service work to the electric vehicle. What current electrical power connection assemblies lack are additional features that may provide an electrical power connection assembly that is easier to assemble, handle, and use while also having increased robustness. The combination of these additional features may provide added convenience and safety for a human assembler or service technician that may be required to handle or service the electrical connection assembly, or system.

Thus, what is needed is a reliable electrical connection system that is easy to assemble, handle, and use that also has increased robustness to provide added convenience and safety for individuals that handle or service the electrical connection system.

SUMMARY OF THE INVENTION

In accordance with one embodiment of the invention, an electrical connection system includes a mating axis and a first connector axially matable to a second connector. The first connector includes a connector body having a primary and a secondary latch where at least the primary latch is spaced apart from the connector body to define a space having an open end. The primary and the secondary latch are constructed integrally integral with the connector body so that the connector body is formed as a single unitary piece. The space is adapted to fit a latch position assurance lock so that the latch position assurance lock is fitted in to the space to prevent displacement of the primary latch.

In another embodiment of the invention, a method is provided to assemble an electrical connection system. The method includes a step of receiving a first connector body into a second connector body. The first connector body includes wire conductors attached to terminals and the second connector body also includes wire conductors attached to terminals. The connector body of the first connector includes a primary latch and a secondary latch. The primary latch, the secondary latch and the connector body of the first connector are formed as a single unitary piece. The primary latch is spaced apart from the connector body of the first connector to define a space and the space is adapted to fit a latch position assurance lock.

In accordance with yet another embodiment of the invention, an electrical connection system includes a mating axis and a first connector axially matable to a second connector. The first connector includes a connector body having a primary and a secondary latch where at least the primary latch is spaced apart from the connector body to define a space. The primary and the secondary latch are molded integrally integral with the connector body so that the connector body is formed of a single unitary piece. The single unitary piece is formed in a mold that includes a primary axial mold portion, a secondary axial mold portion, and an orthogonal slide mold portion. The mold portions collectively combine in a mold arrangement to define a mold cavity. The secondary mold portion is adapted to axially engage the primary mold portion and the slide mold portion is adapted to engage and overlie at least a portion of the primary mold portion and a portion of the secondary mold portion. The connector body is molded in the mold cavity by virtue of external surfaces of the primary and the secondary latch that face the connector body being molded so that there is no overlap as seen in an axial direction. The slide mold portion is adapted to mold at least the respective external surfaces of the primary and the secondary latch facing away from the connector body. At least one of the axial mold portions includes a raised mold element. When the respective mold portions are separated to release the molded connector body from the cavity, the molded connector body is at least axially withdrawn from the mold element so that the mold element relinquishes the space. The space is adapted to fit a latch position assurance lock that underlies the primary latch.

BRIEF DESCRIPTION OF THE DRAWINGS

This invention will be further described with reference to the accompanying drawings in which.

DETAILED DESCRIPTION OF THE PREFERRED EMBODIMENTS

Figure 1:
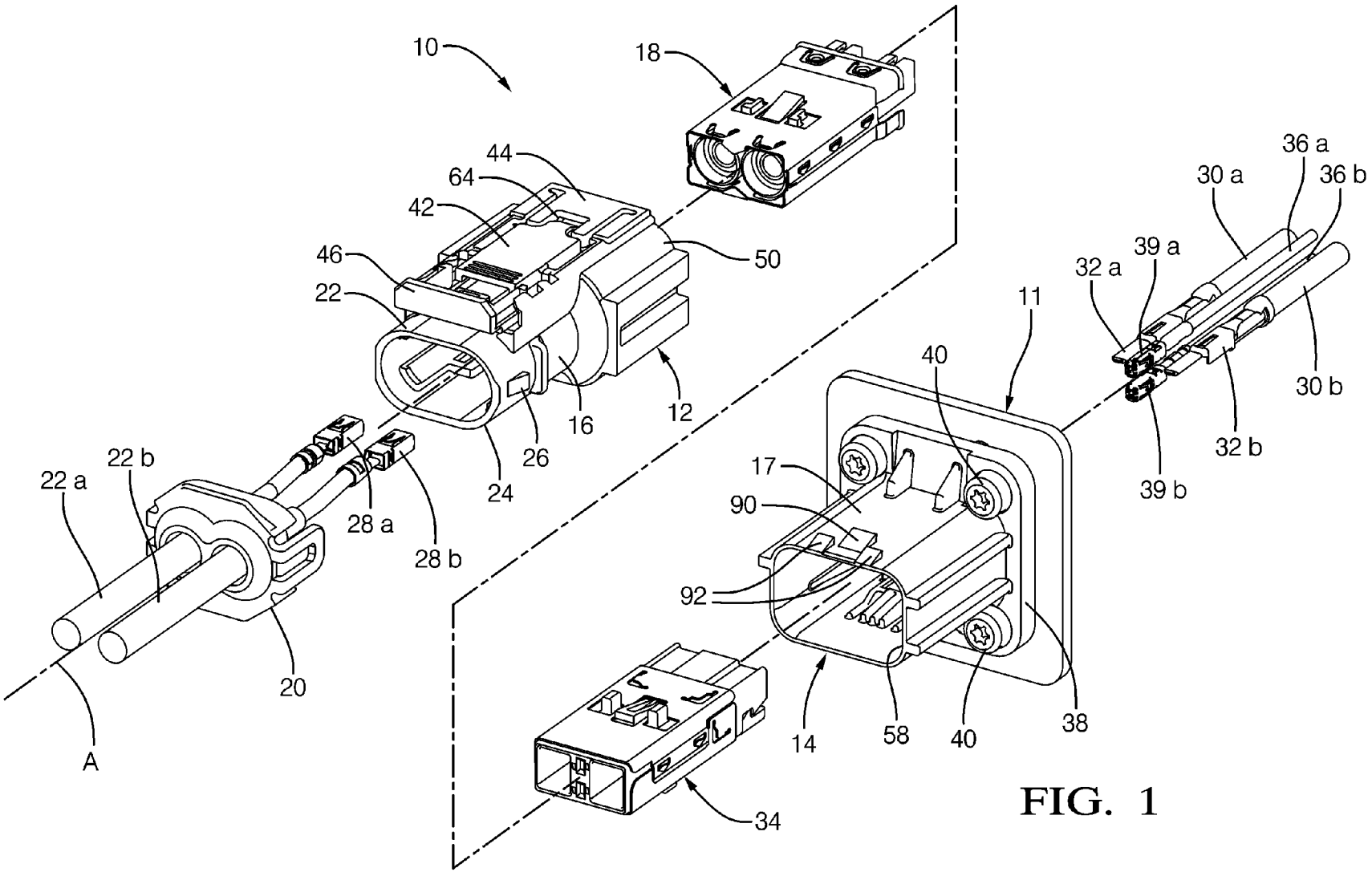
FIG. 1 shows an exploded view of an electrical connection system that includes a plug and a header connector in accordance to the invention.

Referring to FIG. 1, in accordance with preferred embodiments of this invention, an electrical connection system 10 is presented. Electrical connection system 10 is used to electrically transmit electrical signals through system 10 from one location to another location. System 10 is attached, or secured to a bulkhead, or case 11. For example, the case may be part of an enclosure to house high-voltage batteries disposed in an electric or hybrid electric vehicle (not shown). The electrical connection system may be a useful interface to bridge and electrically transmit and distribute power electrical signals supplied from the high-voltage batteries at one location through the case to other electrical components disposed external to the case in the vehicle at other locations.

Referring to FIGS. 1-13, electrical connection system 10 includes a first, plug shroud, or plug connector 12 and a second, header shroud, or header connector 14 that receives, and is mateable with plug connector 12 along a mating axis A. Referring to FIG. 1, plug connector 12 includes a plug connector body 16 and header connector 14 includes a header connector body 17. Connector bodies 16, 17 have complimentary tubular, oval-type shapes. Alternately, the connector bodies may have any complimentary shape that allows connector bodies 16, 17 to be suitably mated together. Connector bodies 16, 17 are formed from a dielectric thermoplastic material. A female wiring subassembly 18 is adapted to be received and retained within tabs (not shown) within a cavity 25 of plug connector 12. Wire subassembly 18 is injection molded being formed of a similar material as connector bodies 16, 17. Plug connector 12 further includes an end cover 20 that receives insulated wire conductors 22 and is securable to a rearward section 24 of connector body 16 to a pair of laterally spaced tabs 26 located at rearward section 24 of plug connector 12. End cover 20 is formed of the same material as connector bodies 16, 17 previously discussed. Connector bodies 12, 14 and end cover 20 are constructed by injection molding. Apertures in end cover 20 are sized to engage the outer insulation of wire conductors 22*a*, 22*b* when end cover 20 is secured to connector body 16. Apertures in end cover 20 provide strain relief for wire conductors 22*a*, 22*b* when wire conductors 22*a*, 22*b* are disposed in plug connector 12. System 10 transmits a first set of electrical signals and a second set of electrical signals. The first set of electrical signals controls the electrical transmission of the second set of electrical signals through system 10. Wire conductors 36*a*, 36*b* carry the first set of electrical signals, or control electrical signals. Wire conductors 22*a*, 22*b* carry the second set of electrical signals, or power electrical signals through system 10 when plug connector 12 is mated with header connector 14. The control electrical signals carried on wire conductors 36*a*, 36*b* control the power electrical signals carried on wire conductors 22*a*, 22*b*. Female terminals 28*a*, 28*b* are secured to respective exposed leads of an electrically conductive core (not shown) of wire conductors 22*a*, 22*b* by any suitable method known in the art, such as crimping. Terminals 28*a*, 28*b* are formed of an electrically conductive material, such as tin, brass, gold, and the like. The terminals have a size suitable to carry the current capacity required for a given product application where system 10 is employed. Terminals 28*a*, 28*b* are configured to be received and secured into subassembly 18 and subassembly 18 is configured to be received and secured in connector body 16 of plug connector 12. Wire conductors 22 have a sufficient American Wire Gauge (AWG) size to handle the current capacity required for a given product application that matches the current capacity of the terminals previously discussed. In one embodiment, the AWG size of wire conductors 22 may be typically 12 AWG and may carry a current range of up to 40 $amps_{DC}$.

Figure 4:
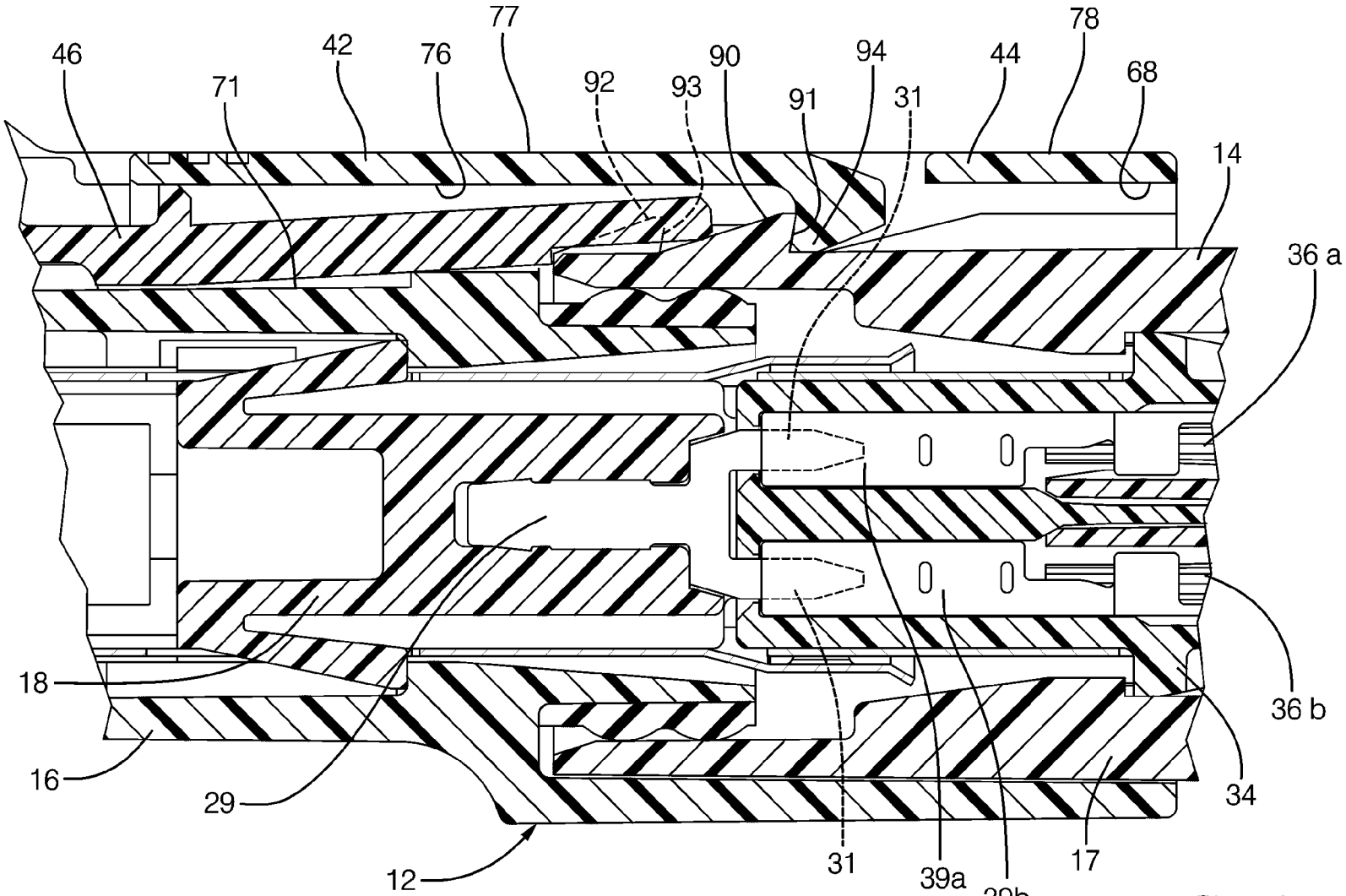
FIG. 4 shows a magnified view of the electrical connection system of FIG. 3, showing inner details thereof.

Header connector 14 has similar corresponding components made of similar materials as plug connector 12 previously discussed that allow connector body 17 of header connector 14 to mate with connector body 16 of plug connector 12. Header connector 14 includes insulated wire conductors 30*a*, 30*b* connected with male terminals 32*a*, 32*b* that are further mechanically and electrically connected in a male wire subassembly 34. Wire conductors 30*a*, 30*b* carry the power electrical signals to corresponding wire conductors 22*a*, 22*b* in plug connector 12. Wire assembly 34 is adapted to be secured and retained in a cavity 59 of connector body 17 of header connector 14. Wiring subassembly 18 including terminals 28 of plug connector 12 mate with complimentary wiring subassembly 34 including terminals 32 when connectors 12, 14 are mated. In contrast with plug connector 12, header connector 14 also includes wire conductors 36*a*, 36*b* connected to female terminals 39*a*, 39*b* that carry the control electrical signals previously discussed herein. The power electrical signals are carried on wire conductors 22, 30 through system 10 when connectors 12, 14 are mated. Wire conductors 36*a*, 36*b* and terminals 39*a*, 39*b* carry the control electrical signals form an electrical loop in system 10 such that when connecters 12, 14 are at least partially disconnected, the electrical connection between wire conductors 36*a*, 36*b* carrying the control electrical signals is broken. The electrical loop is completed in system 10 when connectors 12, 14 are mated via a forked-shaped electrically conductive terminal 29. Terminal 29 is disposed in a recess of subassembly 18. Fork-shaped terminal 29 has two male blades 31 that extend towards an opening 52 of plug connector 12. Blades 31 electrically connect with terminals 39*a*, 39*b* when connectors 12, 14 are mated, as best illustrated in FIG. 4. Forked-shaped terminal 29 and terminals 32, 39 are formed of similar materials as terminals 28 as previously discussed herein. Wire conductors 36 and terminals 39 carrying the control electrical signals have a decreased electrical current range than that of the power electrical signals, and thus, the physical size of wire conductors 36 and terminals 39 is smaller than wire conductors 22, 30 and terminals 28, 32 carrying the power electrical signals. Terminals 32 are secured in subassembly 34. Header connector 14 also includes an outer flange 38 surrounding connector body 17 of header connector 14. Flange 38 is rectangular and defines holes at the corners through which fasteners 40 are disposed to attach and mount header connector 14 to case 11. Alternately, the flange may be formed in any suitable shape for fastening to the case. Fastener 40 is a star head-type screw. Alternately, any type of fastener may be used that sufficiently secures the flange to a supporting structure and may include other screw types, rivets, and the like. Referring to FIG. 1, connector body 17 of header connector 14 also includes a primary latch ramp 90 and a plurality of laterally-spaced secondary latch ramps 92. Secondary ramps 92 are laterally disposed outbound, and spaced axially aft of primary latch ramp 90 in a direction towards an opening 58 on an external surface of connector body 17 and in a direction of connectors 12, 14 being unmated. A portion of secondary latch ramps 92 are disposed adjacent to opening 58 of connector body 17. Primary latch ramp 90 is disposed intermediate, and forward of secondary latch ramps 92 on connector body 17. Primary latch ramp 90 includes a ramp portion 118, an apex 114, and a shoulder 91. Secondary latch ramps 92 include respective ramp portions 120, respective apexes 116, and shoulders 93. Primary latch 42 is in communication with primary latch ramp 90 and secondary latch 44 is in communication with secondary latch ramps 92 when connectors 12, 14 are being mated and unmated. System 10 may also include cable seals (not shown) that protect the wiring subassemblies and the terminal/wire conductor connections in the electrical connection system from environmental elements that may cause undesired corrosion to the wire assemblies and the terminals in the electrical connection system, such as water and dust.

Figure 11:
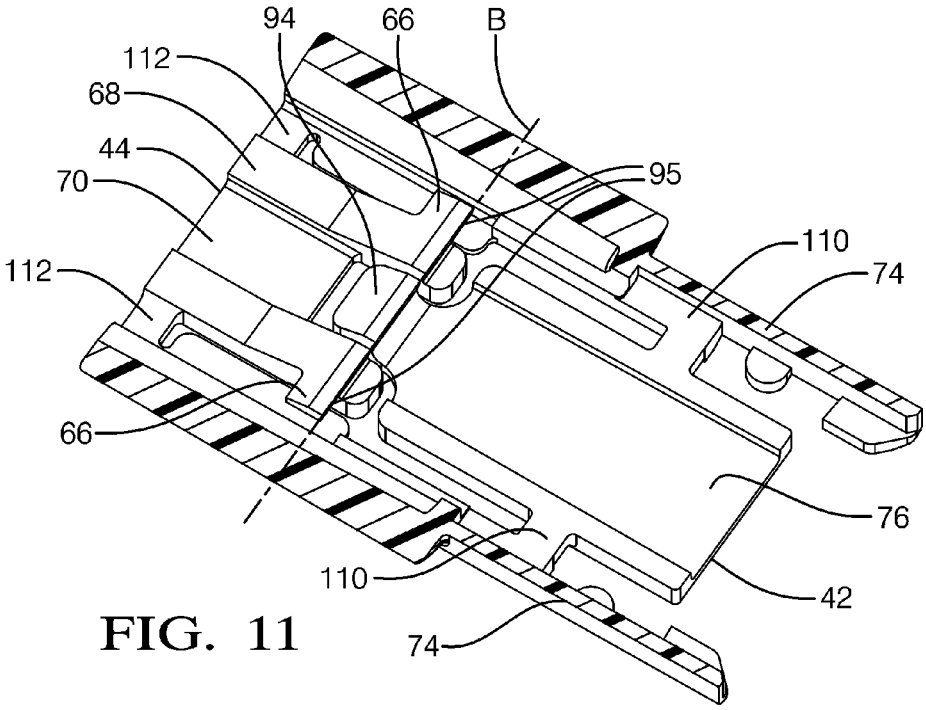
FIG. 11 shows an underside view of the primary and the secondary latch of the connector body of FIG. 10, with the connector body removed.

Referring more specifically to FIGS. 1-13, plug connector 12 has a connector body 16 that includes a primary latch 42, a secondary latch 44, and a latch position assurance lock 46, and a lower, or underlying wall 71 that extends towards, and into cavity 25. Connector body 16 and primary and secondary latches 42, 44 are injection molded to form a single unitary piece. Primary and secondary latch 42, 44 are each integral with connector body 16 and formed as an extension of an outer external surface 54 of connector body 16. A rearward portion of primary latch 42 overlies underlying wall 71 and a forward portion of primary latch 42 is adjacent to cavity 25. Secondary latch 44 has a U-shape. Secondary latch 44 is adjacent to cavity 25 and the base portion of the U-shape of secondary latch 44 is adjacent to opening 52. Latches 42, 44 are disposed along a common axial portion being adjacent to one another along an axial length of connector body 16, as best illustrated in FIG. 11. Latches 42, 44 are also axially spaced apart along this common axial portion. Primary latch 42 is disposed at rearward section 24 of plug connector 12 and secondary latch 44 is disposed ahead of, or forward of primary latch 42 at a forward section 50 of connector body 16. Primary latch 42 and connector body 16 define a space 72 having an open end. Space 72 is intermediate primary latch 42 and underlying wall 71 of connector body 16 of plug connector 12. The open end of space 72 faces away from opening 52 of plug connector 12. Latch position assurance lock 46 fits into space 72 through the open end of space 72. Primary latch 42 has a generally planar top-side external surface 77 and a generally planar underside external surface 76 opposing top-side surface 77. Secondary latch 44 has a generally planar top-side external surface 78 and a generally planar underside external surface 68 opposing top-side surface 78. Underside surface 76 of primary latch 42 faces underlying wall 71 and cavity 25 and underside surface 68 of secondary latch 44 faces cavity 25. Top-side surfaces 77, 78 face outwardly away from underlying wall 71 and/or cavity 25 of connector body 16.

Latches 42, 44 further define an aperture 64 between primary and secondary latch 42, 44. Primary latch 42 has a forward-sloping extending portion 79 adjacent aperture 64. Plug connector 12 is received in to an opening 58 in header connector 14 when connecters 12, 14 are mated. Primary latch 42 and secondary latch 44 are each generally planer. A plane defined along a top-side external surface 77 of primary latch 42 and a top-side external surface 78 of secondary latch 44 is such that latches 42, 44 are generally also disposed in this plane. This plane has a generally parallel, spaced relationship with axis A. The planar configuration of primary and secondary latch 42, 44 is useful to allow plug connector 12 to have a low profile. The low profile of plug connector 12 allows at least plug connector 12 to be more easily navigated through apertures in a vehicle body or a battery enclosure during assembly of electrical connection system 10 in the electric vehicle during vehicle assembly. Latches 42, 44 are cantilevered latches that display independent cantilevered action from each other with respect to connector body 16 of plug connector 12 when latches 42, 44 are respectively actuated.

Figure 5:
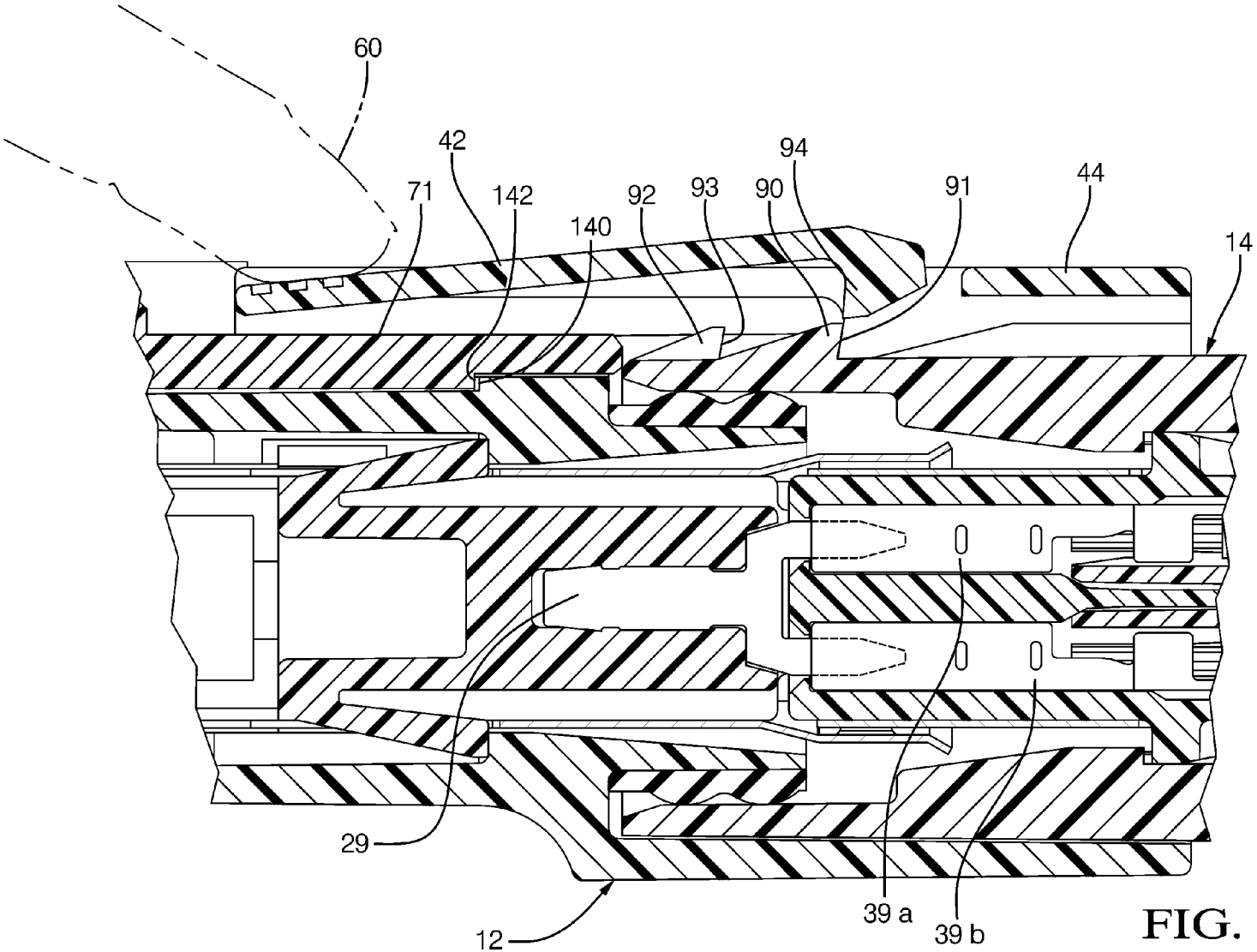
FIG. 5 shows the electrical connection system of FIG. 4 with the latch position assurance lock removed from the space underlying the primary latch and the primary latch being actuated.
Figure 7:
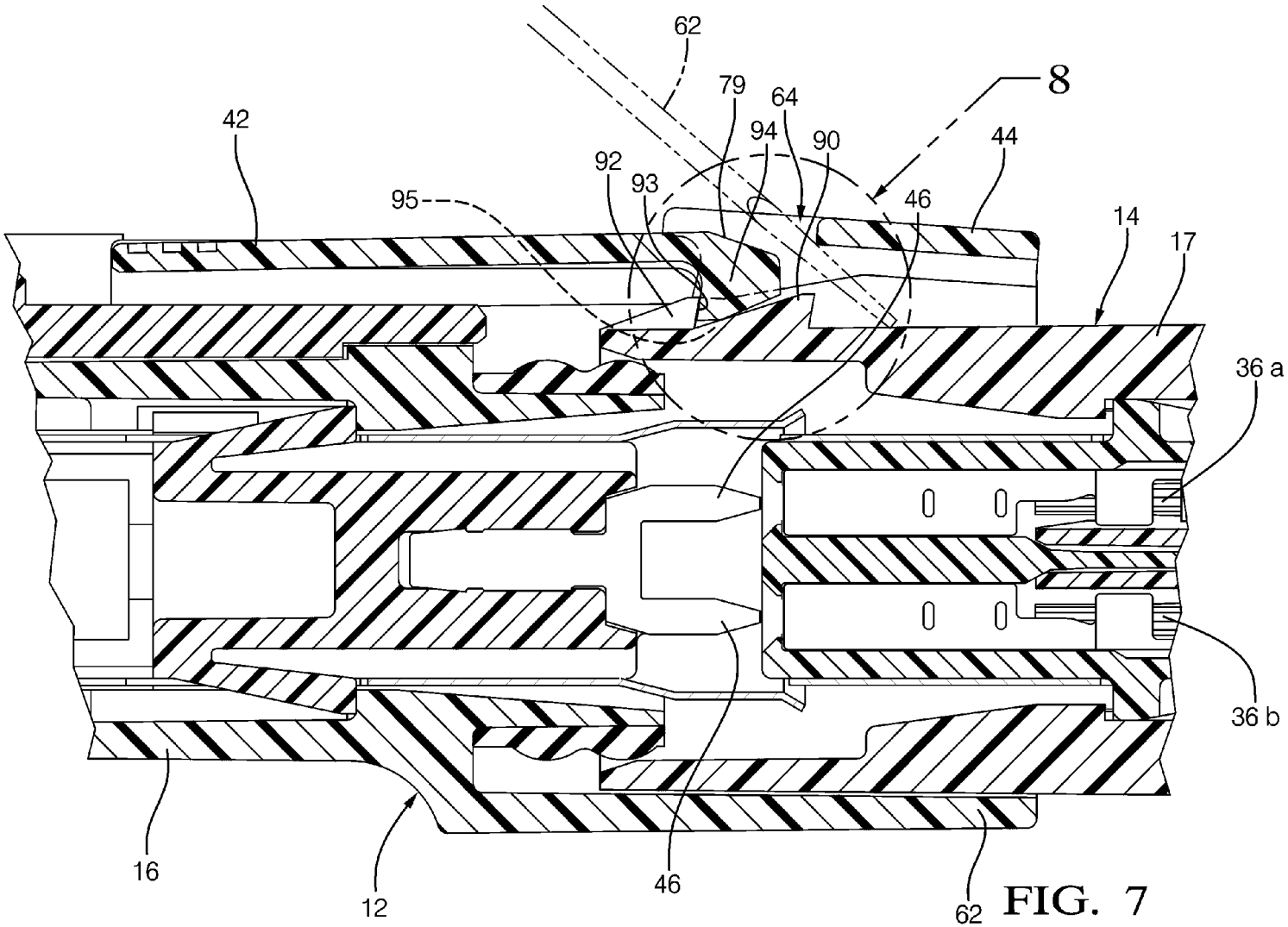
FIG. 7 shows the power connection system of FIG. 6 with a tool inserted into an aperture adjacent a secondary latch on the plug connector.
Figure 8C:
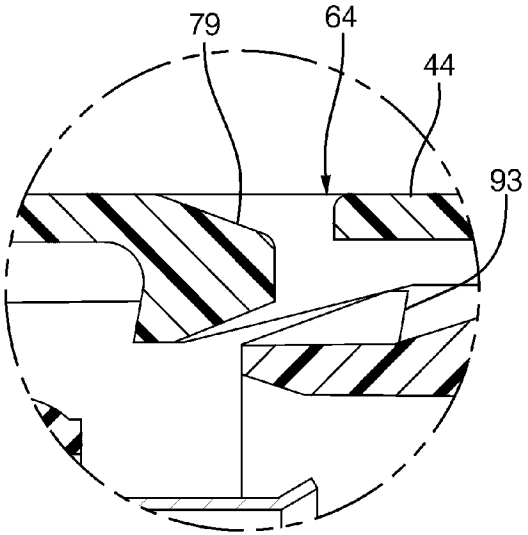
FIGS. 8A-8C show a magnified view of the primary and secondary latches of the power connection system of FIG. 7 illustrating progressive communication of nibs disposed on the primary and the secondary latches with the respective primary and secondary latch ramps on the header connector as the plug and the header connector are unmated.
Figure 8B:
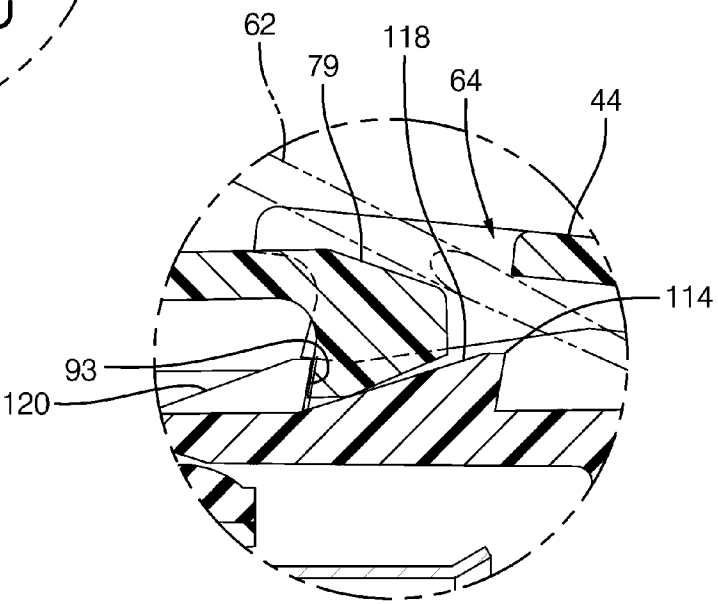
Figure 8A:
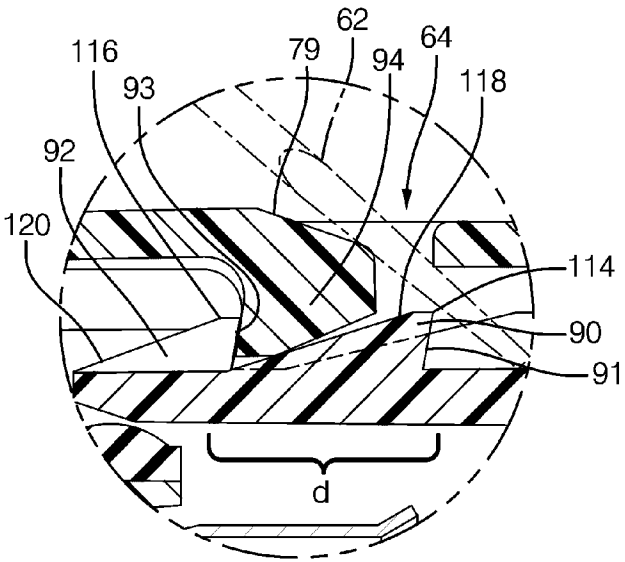
Figure 9:
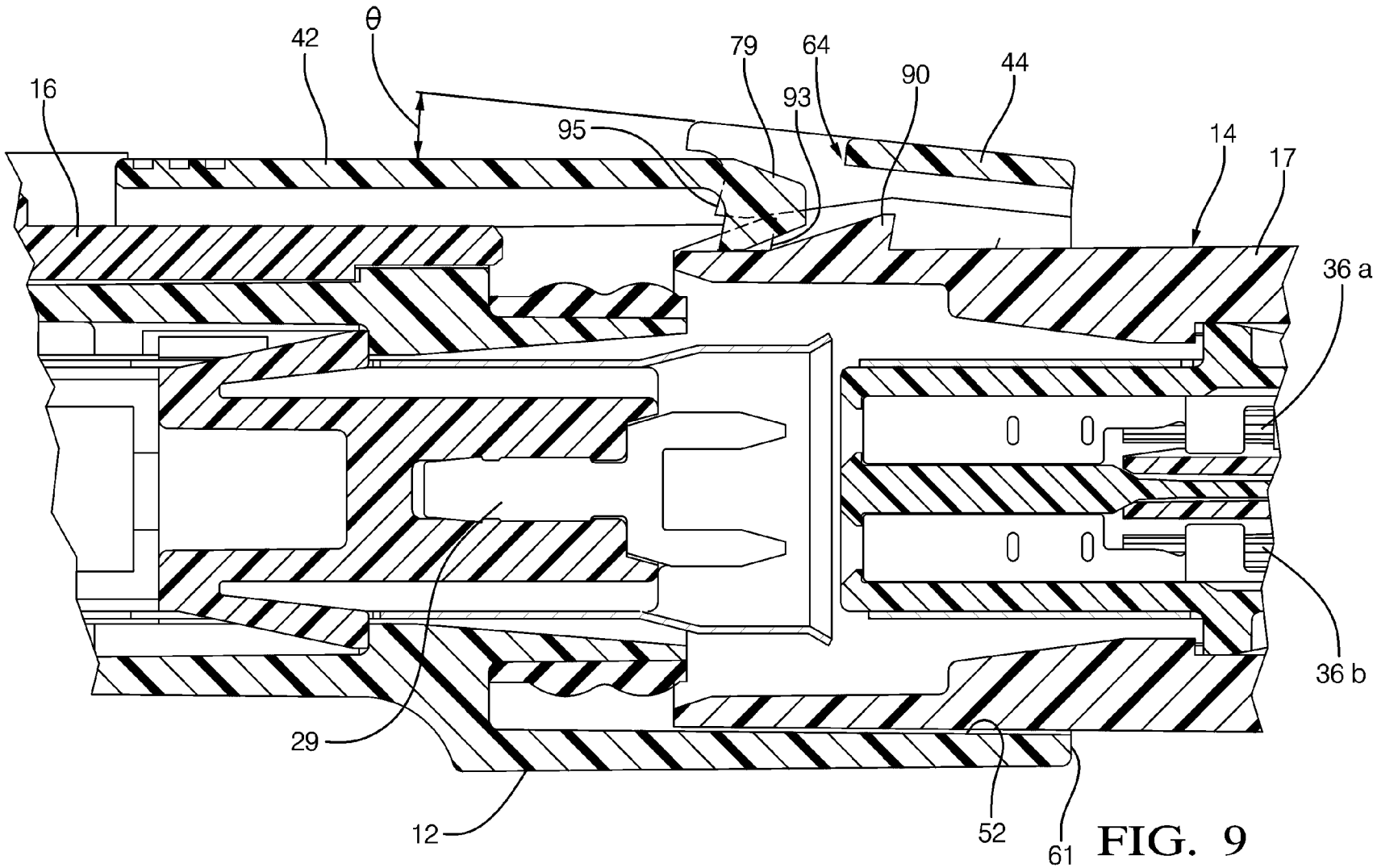
FIG. 9 shows the electrical connection system of FIG. 7 where the secondary latch is disposed in the stationary elevated position and the tool is removed from the aperture.
Figure 10:
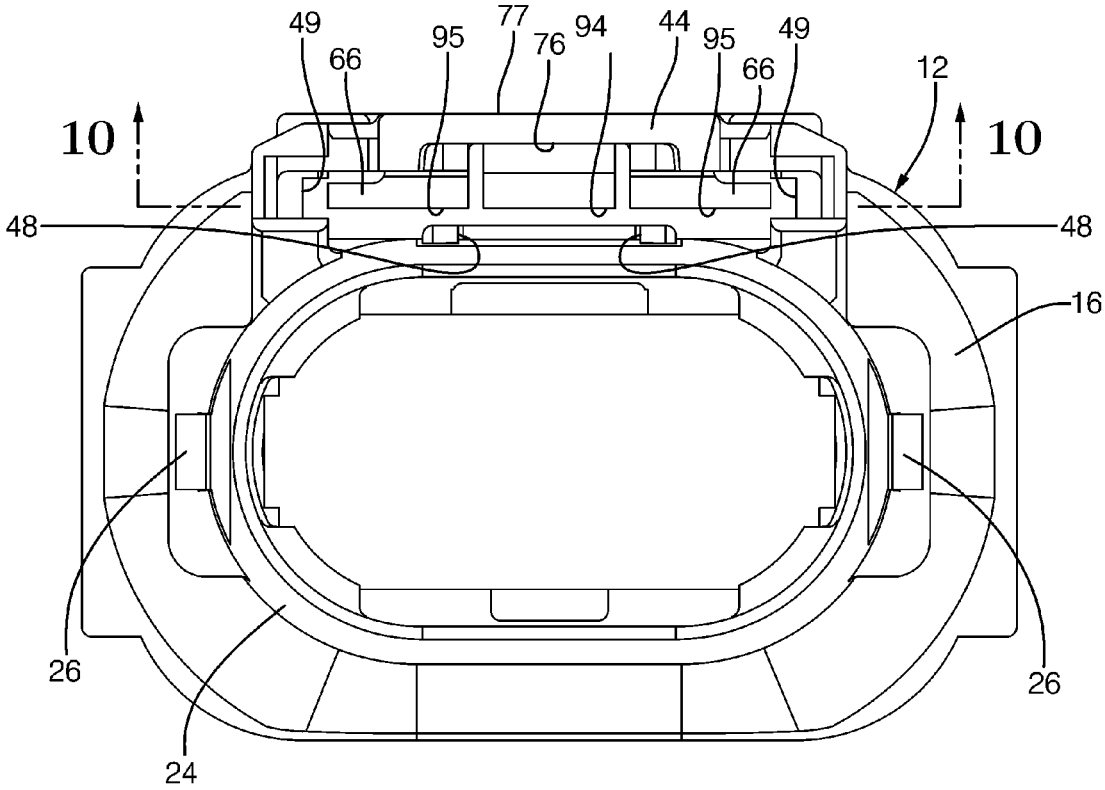
FIG. 10 shows an end view looking in to the rearward section of the connector body of the plug connector of FIG. 1, showing latch details thereof.

Referring to FIG. 5, primary latch 42 is actuated with a downward force applied on primary latch 42 in a direction towards underlying wall 71 of connector body 16, such as may occur when latch 42 is depressed with a forefinger 60 of a human hand of a human operator or service technician. Actuation of primary latch 42 occurs when latch position assurance lock 46 does not underlie, or is void of space 72 underlying primary latch 42. Secondary latch 44 is actuated by engagement of secondary latch 44 with a tool 62 to lift at least a portion of secondary latch 44 in a direction away from cavity 25 of connector body 16. Forward-sloping section 79 of primary latch 42 adjacent aperture 64 provides a guide for insertion of tool 62 to enter aperture 64 at an acute angle with respect to top-side external surfaces 77, 78 of latches 42, 44. FIG. 8A shows tool 62 after initial insertion into aperture 64. Tool 62 engages secondary latch 44 through aperture 64 disposed intermediate primary and secondary latch 42, 44. Referring to FIGS. 7, 8A and 8B, tool 62 is a flat-bladed screwdriver having a blade size suitable to fit into aperture 64. Alternately, the tool may be any tool having a relatively flat-bladed end that fits in aperture 64 and is operable as a lever to lift secondary latch 44. FIG. 8B shows tool 62 being used as a lever and forward-sloping section 79 of primary latch 42 providing a fulcrum for an end of tool 62 to engage underside surface 68 of secondary latch 44 to urge secondary latch 44 from the neutral position to a stationary elevated position of secondary latch 44. Once secondary latch 44 is disposed, and remains in the stationary elevated position, tool 62 may be removed from aperture 64, as illustrated in FIGS. 8C and 9, because tool 62 is no longer needed to hold secondary latch 44 in a raised, or elevated position. In the stationary elevated position, at least a portion of secondary latch 44 extends above the axial plane defined along exterior surfaces 77, 78 of primary and secondary latches 42, 44, as previously discussed herein. The portion of secondary latch 44 raised above this plane is that part of secondary latch 44 adjacent aperture 64, as best shown in FIG. 9. When secondary latch 44 is in the stationary elevated position, secondary latch 44 has an angle of rotation Θ in relation to the axial plane. Angle of rotation Θ is preferably an acute angle. The stationary elevated position is attained and maintained when system 10 is disposed in the partially unmated position as lock ramps 90, 92 are suitably and effectively positioned relative to respective latches 42, 44 so that nib 94 of primary latch 42 rests on ramp portion 118 of primary latch ramp 90 and nibs 95 of secondary latch 44 rest on apexes 116 of secondary latch ramp 92. As nibs 95 of secondary latch 44 rest on apexes 116, this raises, or lifts secondary latch 44 so that secondary latch 44 rotates by angle of rotation Θ. The stationary elevated position of secondary latch 44 is useful so that the service technician may remove tool 62 and fully unmate connectors 12, 14 of system 10 with a single human hand. This feature may be especially useful when system 10 is disposed in a location that has limited access, such as may be the case, for example, in the electric vehicle. The downwardly sloping ramp portion 118 of primary latch ramp 90 towards opening 58 of second connector 14 along with the position of nib 94 of primary latch 42 at the bottom of ramp portion 118 ensures connectors 12, 14 are urged outwardly away from each other when being unmated and not inadvertently urged, or pushed back together toward the mated position along axis A if tool 62 is, for some reason, used again to communicate with secondary latch 44 through aperture 64. Ramp portion 118 transitions into a generally horizontal exterior surface of body connector 17. When first connector 12 is fully unmated from second connector 14, nibs 94, 95 no longer communicate with ramp portions 118, 120 so that secondary latch 44 returns again to the neutral position.

Secondary latch 44 further contains on overstress feature that includes a pair of overstress tabs 66 disposed on an underside surface 68 of secondary latch 44 that faces connector body 16 to prevent overstress to secondary latch 44 when underside surface 68 of secondary latch 44 is engaged by tool 62 during actuation of secondary latch 44. Referring to FIG. 11, overstress tabs 66 are laterally spaced apart perpendicular to axis A disposed outbound of a main section 70 of secondary latch 44 along axis B. Overstress tabs 66 limit the travel of secondary latch 44 when tabs 66 communicate and bottom out adjacent to cavity 25 of connector body 16 of plug connector 12. For instance, in many applications using electrical connection system 10 unmating of connectors 12, 14 may only be desired when system 10, or electrical components in electrical connection with system 10, require a service repair.

Figure 2:
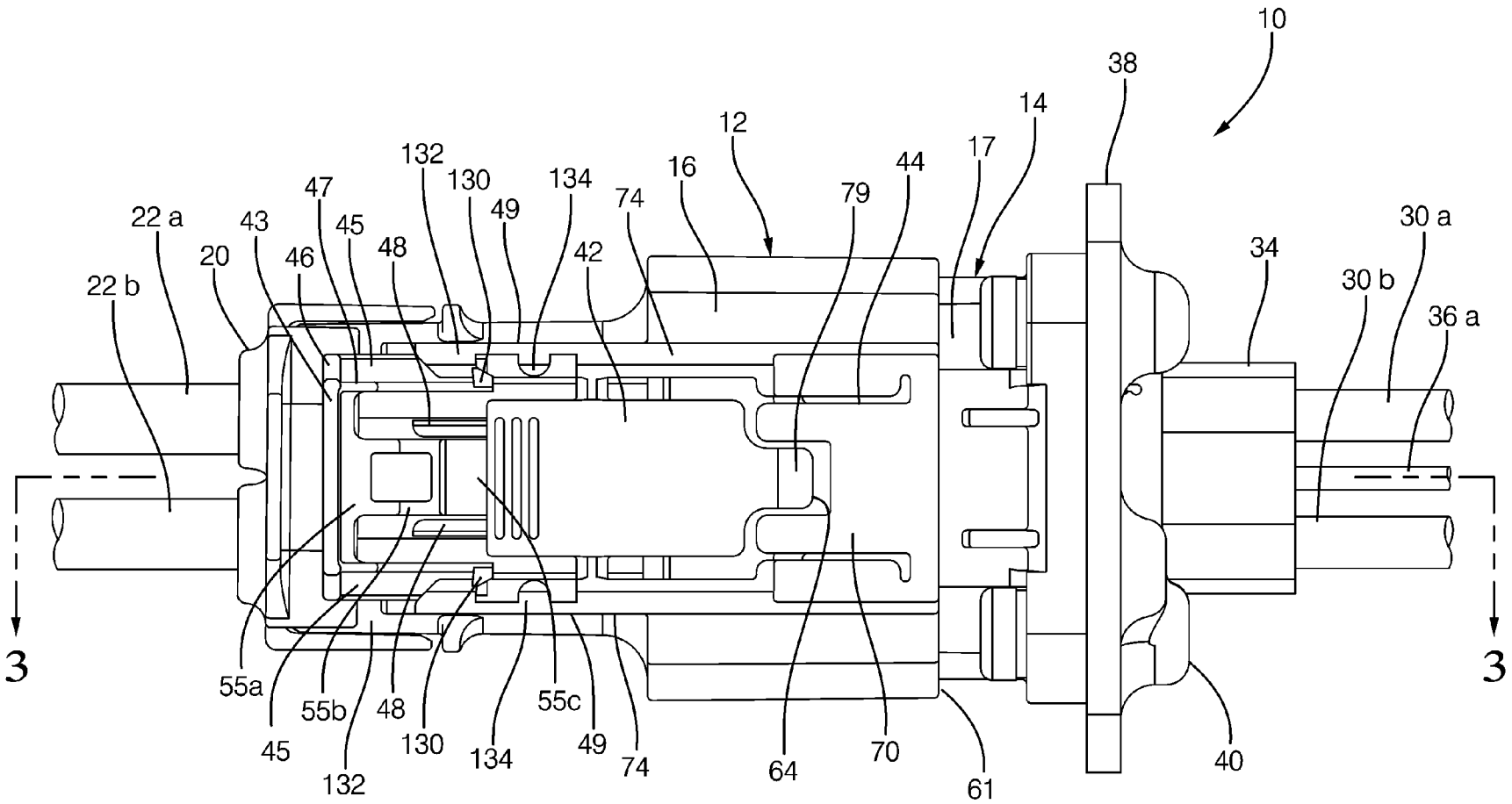
FIG. 2 shows a top view the electrical connection system of FIG. 1 fully mated with the a latch position assurance lock in the lock position underlying the primary latch.
Figure 3:
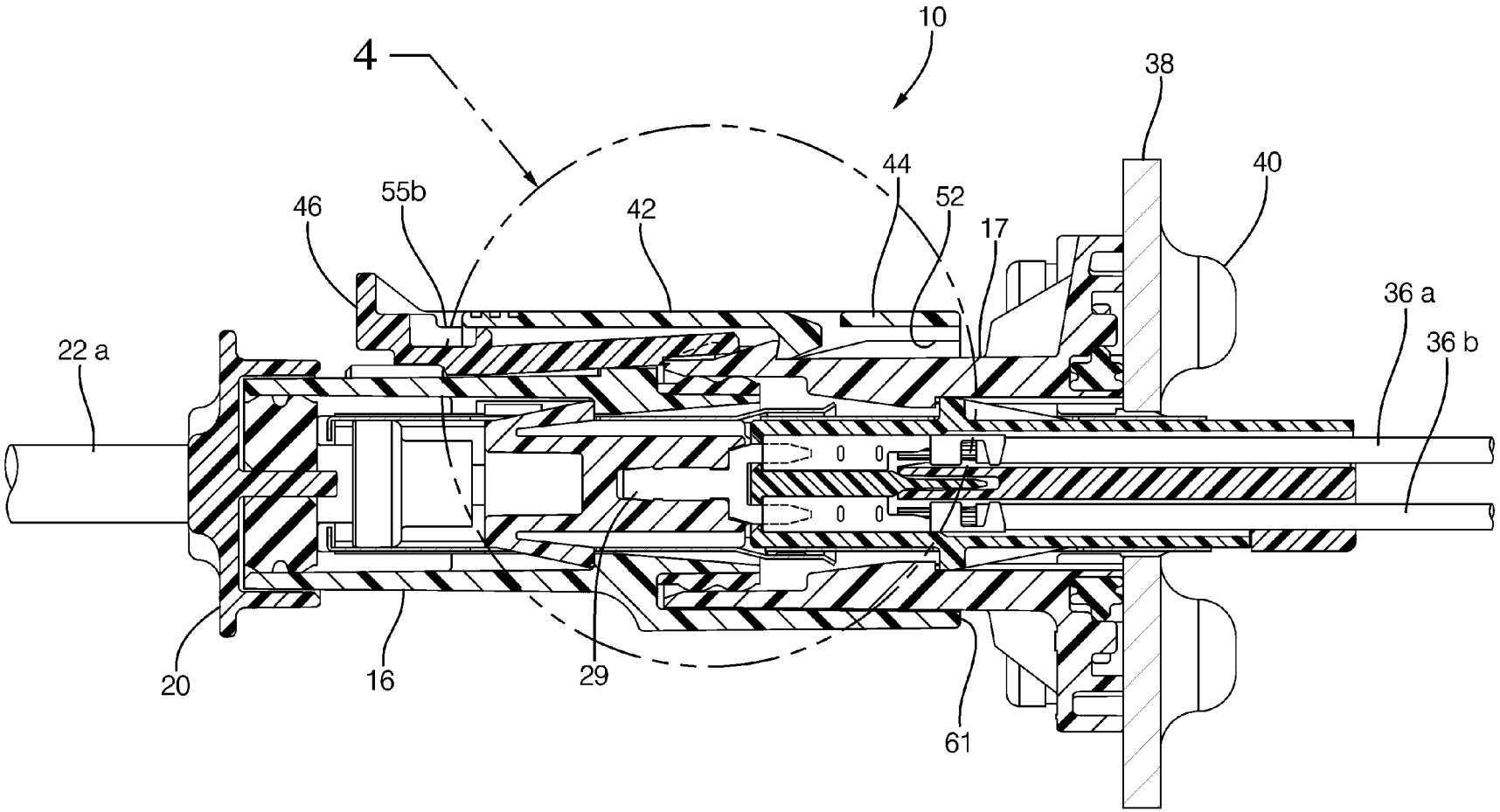
FIG. 3 shows a cross section view of the electrical connection system of FIG. 2, along the lines 3-3.
Figure 6:
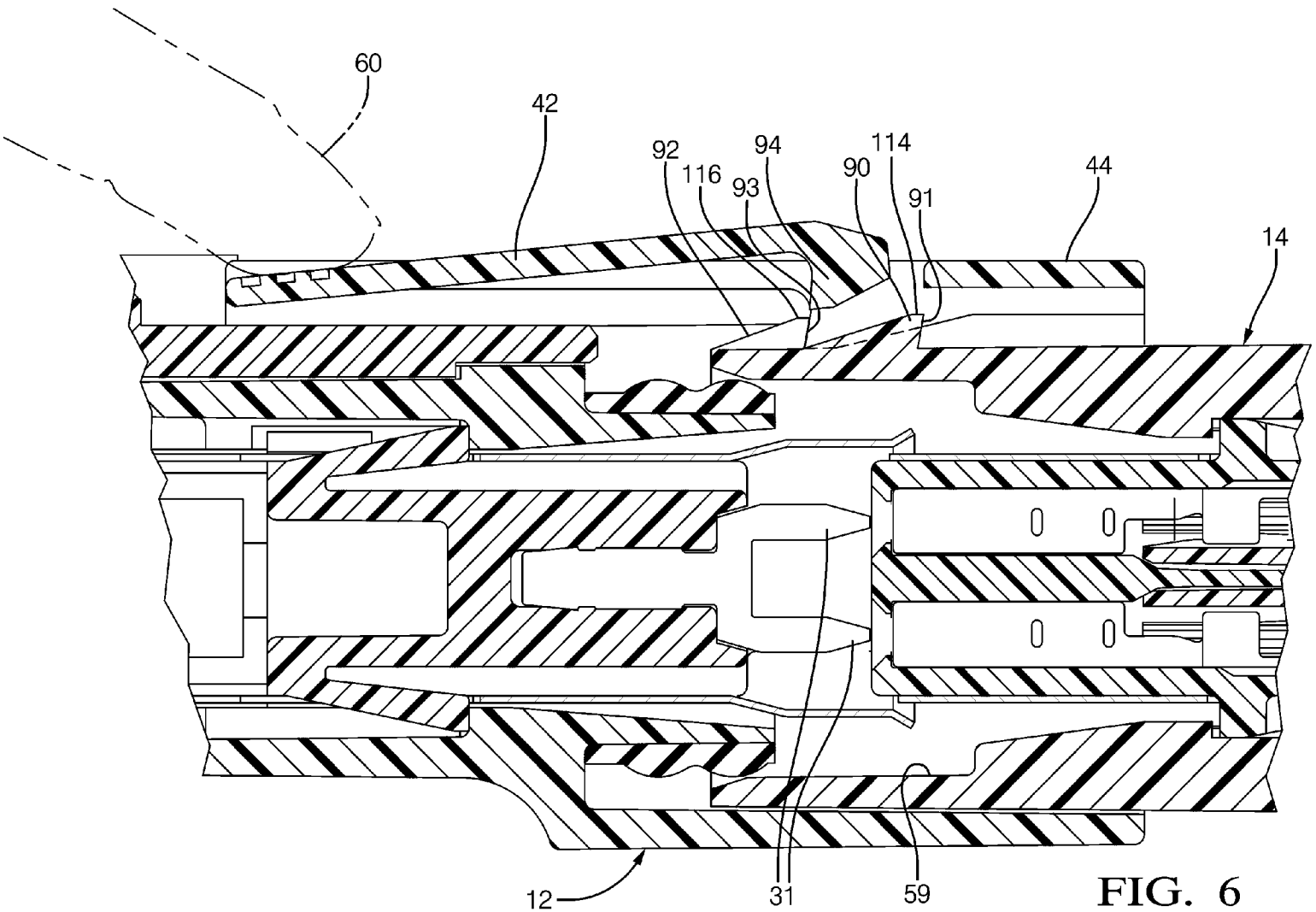
FIG. 6 shows the electrical connection system of FIG. 5 with the plug connector being partially unmated from the header connector.

Latch position assurance lock 46 is a separate and distinct piece from connector body 16. Latch position assurance lock 46 is secured into tracks 48, 49 of connector body 16 and is initially secured to connector body 16 when end nibs 130 of latch position assurance lock 46 engage past detents 132 disposed on track 49 common rails 47. Track 48 is integrally constructed into underlying wall 71 of connector body 16 in rearward section 24. Track 49 is adjacent underlying wall 71 and integrally constructed in to common rails 74 in rearward section 24. Latch position assurance lock 46 includes a base portion 43, two side portions 45, and a main portion 47. Side portions 45 and main portion 47 each extend axially away from base portion 43. Main portion 47 is laterally disposed intermediate side portions 45. Main portion 47 communicates with track 48 when inserted into connector body 16. Main portion 47 includes three step-type structures 55*a-c* with each step 55*a-c* descending in height from the prior step with increasing axial distance in an axial direction along axis A depending away from base portion 43 and towards opening 52 when installed in first connector body 16. Side portions 45 each communicate with a common rail track 49 defined in a portion of common rails 47 adjacent primary latch 42 towards rearward section 24 of connector body 16. Each side portion 45 includes an end nib 130 remote from base portion 43. Common rail track 49 includes a respective first and a second detent 132, 134. Second detent 134 is disposed closer to opening 52 than first detent 132. End nibs 130 communicate with detents 132, 134 depending on the position location of latch position assurance lock 46 relative to space 72. Latch position assurance lock 46 is axially aligned with space 72 in a parallel, spaced relationship to mating axis A along axial tracks 48, 49. End nib 130 of latch position assurance lock 46 engages shoulders of detent 132 to prevent latch position assurance lock 46 from being detachably removed from connector body 16 once initially secured in tracks 48, 49 of connector body 16. When end nib 130 engages detent 132, latch position assurance lock 46 is disposed in the unlock position of latch position assurance lock 46, as best illustrated in FIG. 2. Latch position assurance lock 46 is moveable between the unlock position and a lock position remote from unlock position along tracks 48, 49. When latch position assurance lock 46 is urged along tracks 48, 49 with a force applied at base portion 43, latch position assurance lock 46 is moved to be disposed, or fill space 72 along tracks 48, 49 to adjacently underlie primary latch 42 of connector body 16 in the lock position. Latch position assurance lock 46 fills space 72 when in the lock position. Forward movement of latch position assurance lock 46 into the lock position stops when shoulder 142 abuts a forward edge of connector body 17 of second connector 14. A forward edge of top step structure 55*a* closer is adjacent a rearward edge of primary latch 42 when latch position assurance lock 46 is positioned in the lock position. Top step structure 55*a* is adapted to provide redundancy when latch position assurance lock 46 is movingly urged in the lock position and prevent latch position assurance lock 46 from further undesired insertion in to space 72 by abutting against a rearward edge of primary latch 42. This redundancy feature may prevent undesired concomitant damage to primary latch 42 of connector body 16. End nib 130 communicates with second detent 134 and step-like structure 55*b* engages underside surface 76 to prevent primary latch 42 from being depressed, as best illustrated in FIG. 3. Step-like structure 55*b* provides an interference fit with primary latch 42 to prevent primary latch 42 from being actuated. Space 72 is an open-ended space at rearward section 24 of connector body 16 and track 48 extends into space 72, as best illustrated in FIG. 11. A shoulder 140 on connector body 16 engages against a corresponding shoulder 142 on main portion 47 of latch position assurance lock 46 that prevents latch position assurance lock 46 from being moved into the unlock position before connectors 12, 14 are mated, as best illustrated in FIG. 5. Once connectors 12, 14 have been mated, latch position assurance lock 46 is free of abutment with shoulder 140 so that latch position assurance lock 46 may be urged into the lock position, as best shown in FIG. 4. When connectors 12, 14 are mated, connector body 17 urges against main portion 47 to lift main portion 47 from abutment with shoulder 140 of connector body 16 so latch position assurance lock 46 is moveable into space 72 and disposed in the lock position. When latch position assurance lock 46 is urged and moved away from space 72 such that space 72 is void of latch position assurance lock 46, latch position assurance lock 46 is returned to an unlock position along tracks 48, 49. When latch position assurance lock 46 is in the unlock position, primary latch 42 may be unlocked, or actuated with a force applied to primary latch 42, as best illustrated in FIGS. 5 and 6.

Referring to FIG. 11, primary and secondary latch 42, 44, respectively, have an intermediate, integrally attached relationship to common rails 74 disposed along connector body 16 of plug connector 12 and common rails 74 are integrally attached and formed with connector body 16 of plug connector 12. Integral arms 110 connect primary latch 42 to common rails 74. Arms 110 are disposed near a mid-point of primary latch 42 along an axial length of primary latch 42. Alternately, the arms connecting the primary latch to the common rails are suitable located anywhere along the axial length of the primary latch that allows actuation of the primary latch to raise the nib of the primary latch over the associated primary latch ramp disposed on the connector body of the header connector.

Integral arms 112 attach secondary latch 44 to common rails 74. Integral arms 112 are disposed adjacent edge 61 and opening 52 of connector body 16. Alternately, the integral arms may be located along an axial length of the secondary latch that allows actuation of the secondary latch so that the nibs of the secondary latch clear the shoulders of the associated secondary lock ramps disposed on the header connector. Latches 42, 44 do not physically touch connector body 16 in the neutral position except where integrally connected by arms 110, 112 to common rails 74.

Figure 12:
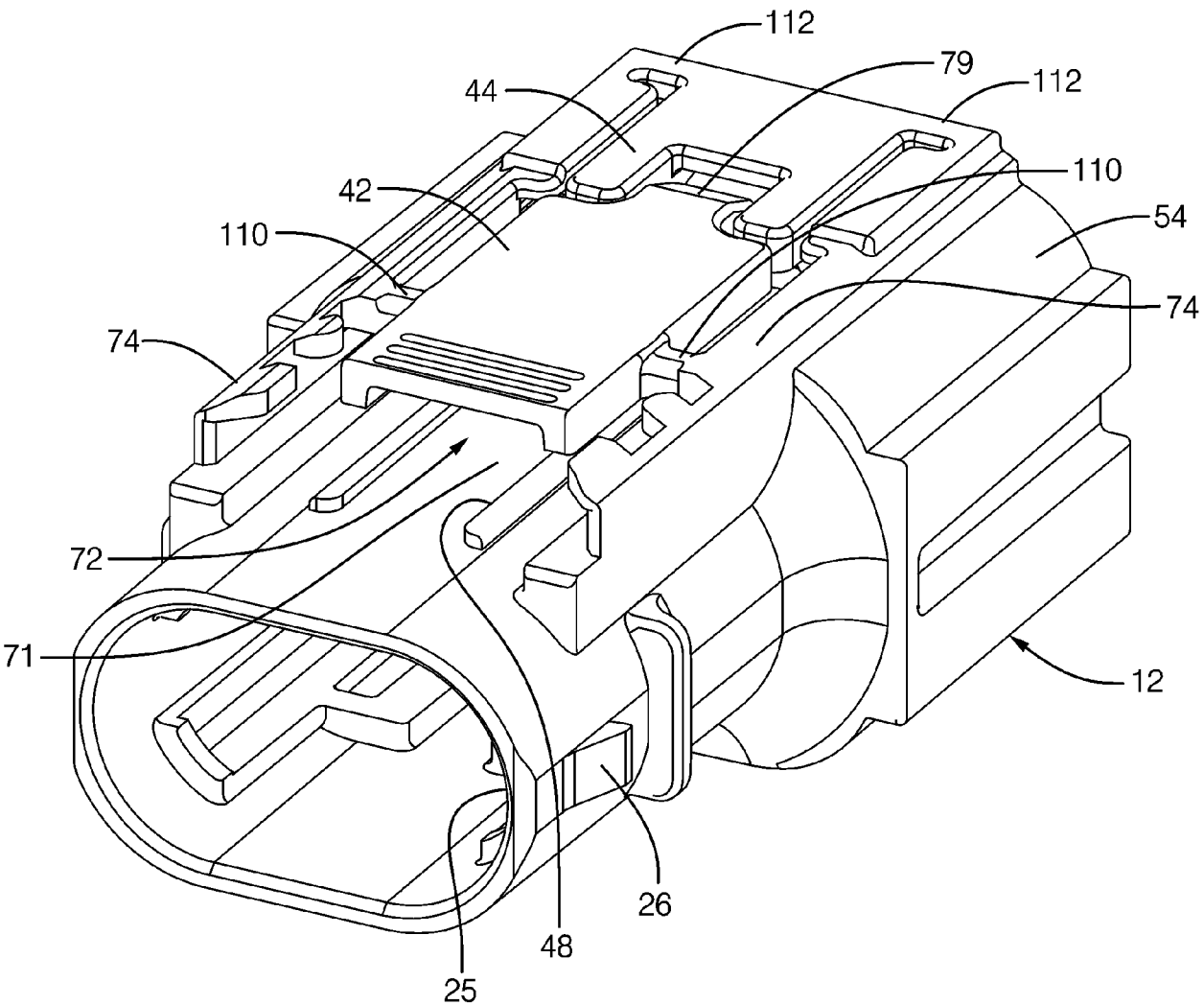
FIG. 12 shows a right-hand perspective view of the connector body of FIG. 10 with the latch position assurance lock not attached to the connector body.
Figure 14:
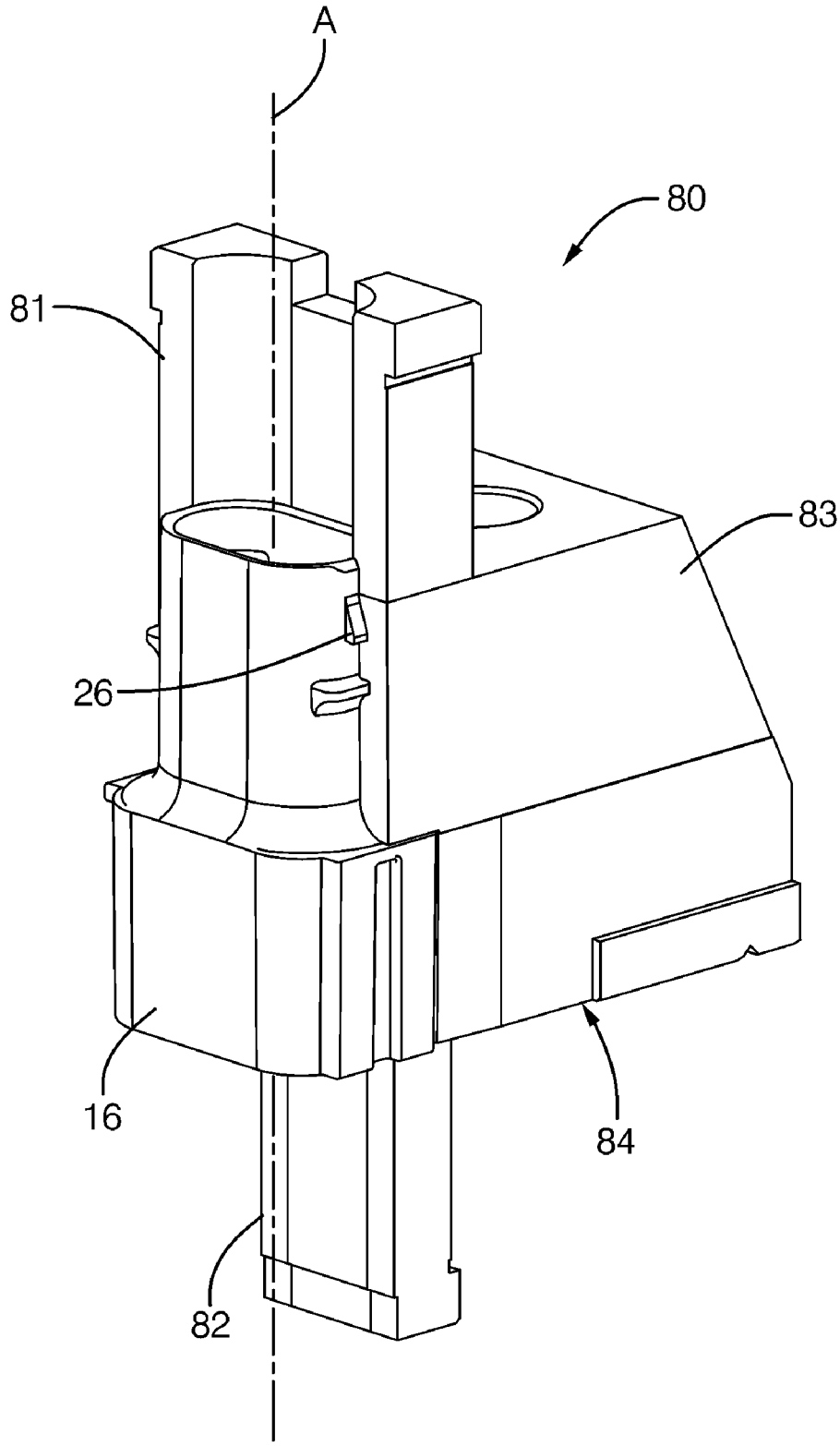
FIG. 14 shows an assembled mold arrangement to mold the connector body of FIG. 12.
Figure 15:
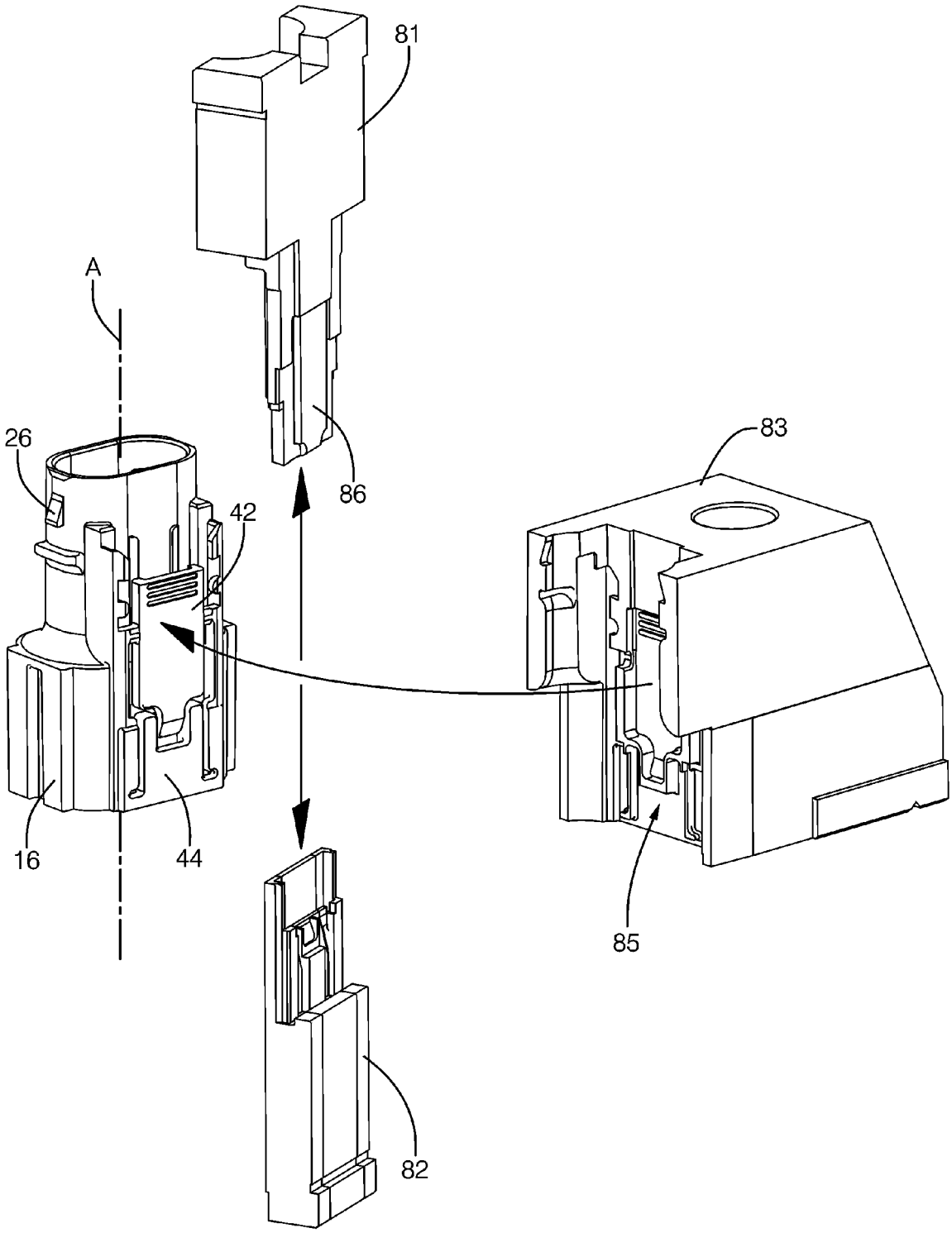
FIG. 15 shows the connectivity of various portions of the mold arrangement of FIG. 14 to mold the connector body of FIG. 12.

Referring to FIGS. 14 and 15, the single unitary piece of connector body 16 of plug connector 12 is formed in an injection mold 80. Mold 80 includes a primary axial mold portion 81, a secondary axial mold portion 82, and an orthogonal slide mold portion 83 that collectively combine in a mold arrangement 84 to define a mold cavity 85 of mold 80. Secondary mold portion 82 is adapted to axially engage primary mold portion 81 and slide mold portion 83 is adapted to engage and overlie at least a portion of primary mold portion 81 and a portion of secondary mold portion 82. Connector body 16 is molded in to the single unitary piece in mold cavity 85 by virtue of an underside external surface 76 of primary latch 42 and underside external surface 68 of secondary latch 44 that face connector body 16 being molded so that there is no overlap as seen in an axial direction with respect to mating axis A. Slide mold portion 83 is adapted to mold at least respective external topside surfaces 77, 78 of primary and secondary latch 42, 44 facing away from connector body 16 of plug connector 12. Primary mold portion 81 includes a raised mold element 86. When respective mold portions 81, 82, 83 are separated to release molded connector body 16, connector body 16 is axially withdrawn from mold element 86 so that mold element 86 relinquishes space 72. The neutral position of latches 42, 44 are defined and established when plug connector 16 is injection molded so that latches 42, 44 are generally in a spaced, parallel alignment to axis A when not being actuated. As such, latches 42, 44 are disposed in the neutral position when released from mold 80, as best illustrated in FIG. 12.

As best illustrated in FIG. 1, ramps 90, 92 have a staggered zigzag arrangement on the external surface of connector body 17 of header connector 14 in a direction generally perpendicular to axis A with secondary latch ramps 92 disposed offset and behind primary latch ramp 90. An axial distance d, as shown in FIG. 8A, between shoulders 91, 93 of primary and secondary latch 42, 44. Distance d is selected for a given geometry size of electrical connection system 10 to ensure that when electrical connection system 10 is partially unmated, blades 31 of terminal 29 are sufficiently unmated from terminals 39*a*, 39*b* so that the electrical connection between wire conductors 36*a*, 36*b* is electrically broken. A time delay is structurally associated with electrical connection system 10 to completely unmate connectors 12, 14 from their mated position. The mated configuration of system 10 is best illustrated in FIG. 2 and the unmated configuration of system 10 is best illustrated in FIG. 8C. One feature of electrical system 10 is that the power electrical signals carried on wire conductors 22, 30 need to cease electrical transmission through system 10 in a time period that is less than the time delay associated with electrical system 10. For the power electrical signals to cease electrical transmission through system 10, the control electrical signals carried on wire conductors 36*a*, 36*b* are electrically broken when connectors 12, 14 are moved to the partially unmated position while the power electrical signals carried on wire conductors 22, 30 remain electrically connected in system 10. A substantial amount of the time delay is attributable to the amount of time needed to actuate secondary latch 44 using tool 62. Without actuation of secondary latch 44, connectors 12, 14 remain connected in the partially connected position. For example, in one embodiment, it may take greater than 3 seconds for the tool to be inserted into aperture and raise secondary latch into the stationary elevated position and completely unmate the first and the second connector in the electrical connection system. Preferably, the amount of time to perform actuation of the secondary latch with the tool is greater than the amount of time for the power electrical signals to cease electrical transmission. Primary latch ramp 90 has a shoulder 91 adjacent primary latch ramp 90. Secondary latch ramps 92 have shoulders 93 adjacent respective secondary latch ramps 92. Primary latch 42 includes a nib 94 on underside surface 76 of primary latch 42 that is adapted to engagingly communicate with primary latch ramp 90 when connectors 12, 14 are mated and unmated. Secondary latch 44 includes nibs 95 disposed on underside surface 68 of secondary latch 12 that are adapted to engagingly communicate with secondary latch ramps 92 when connectors 12, 14 are mated and unmated. As best illustrated in FIG. 11, nibs 94, 95 disposed on respective latches 42, 44 are generally in alignment along axis B. Axis B is spaced apart from, and generally perpendicular to axis A.

If electrical connection between wire conductors 36*a*, 36 *b* carrying the control electrical signals is electrically broken, while the electrical connections of wire conductors 22, 30 and terminals 28, 32 carrying the power electrical signals remain electrically connected when connectors 12, 14 are partially unmated, wire conductors 22, and terminals 28, 32 carrying the power electrical signals will cease transmission of the power electrical signals after a period of time through system 10, but before the time delay associated with system 10 ends, as previously discussed. Terminals 28, 32 generally have a longer length than terminals 39 to ensure a mated connection of terminals 28, 32 when system 10 is partially unmated. Thus, system 10 is adapted to partially unconnect and break electrical connections between wire conductors 36*a*, 36*b* associated with the electrical control signals so that the built-in timing delay to unmate connectors 12, 16 is greater than a time period for transmission of the power electrical signals carried on wire conductors 28, 30 and terminals 28, 32 to cease, or stop.

Referring to FIG. 1, when plug connector 12 is unconnected, or not mated with header connector 14, subassemblies 18, 34 are not connected in electrical connection system 10 so electrical transmission of electrical control signals carried on wire conductors 36*a*, 36*b* and terminal 29 or electrical power electrical signals carried on wire conductors 22, 30 and terminals 28, 32 do not occur through electrical connection system 10.

Figure 13:
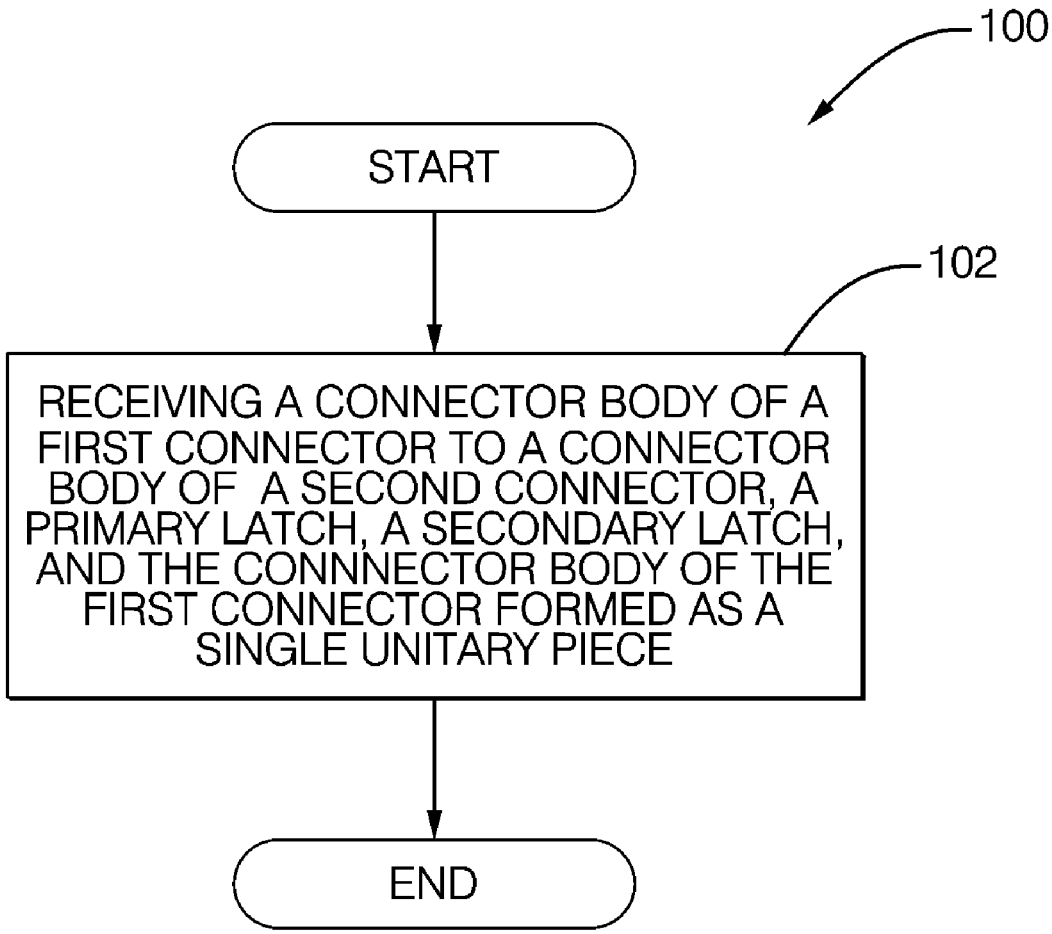
FIG. 13 shows a flow chart of a method to assemble the electrical connection system of FIG. 1.

When connectors 12, 14 are mated from being unconnected, plug connector 12 is inserted towards and received by header connector 14. Referring to FIG. 13, this is step 102 in method 100. Wiring subassembly 18 including female terminals 28 make electrical and mechanical connection with wiring subassembly 34 and terminals 32, 39. As plug connector 12 is inserted into header connector 14, nibs 94, 95 of primary and secondary latch 42, 44, respectively, ride over corresponding ramp portions 118, 120 on latch ramps 90, 92 disposed on header connector 14. When nib 94 of primary latch 42 rides over primary latch ramp 90 connectors 12, 14 are fully mated. Latch position assurance lock 46 may now be movingly urged along tracks 48, 49 to underlie primary latch 42 in space 72 being disposed in the locked position. In the locked position, latch position assurance lock 46 prevents inadvertent actuation of primary latch 42 as previously discussed herein. The mated plug and header connector 12, 14 is best illustrated in FIGS. 2 and 3.

To properly unmate connectors 12, 14, primary latch 42 requires actuation before secondary latch 44 is actuated. And secondary latch 44 requires activation before connectors 12, 14 may be completely unmated. Latch position assurance lock 46 is movingly urged away from space 72 to the unlock position along tracks 48, 49. For example, the latch position assurance lock may be moved away from the space to the unlock position with a forefinger on a human hand of a service technician. When connectors 12, 14 are unmated, connectors 12, 14 are urged to a partially unmated position which is subsequently followed by connectors 12, 14 being completely unmated from one another at a later point in time dependent on the time it takes to actuate latches 42, 44 in the correct order and pull connectors 12, 14 apart. Referring to FIG. 5, primary latch 42 is actuated by applying a force, such as with forefinger 60. As primary latch 42 is depressed, the cantilevered action of primary latch 42 raises nib 94 to clear shoulder 91. When nib 94 clears shoulder 91, connector body 16 may be manually urged away from header connector 14, to the partially unmated position of connectors 12, 14. Referring to FIG. 6, when connectors 12, 14 are partially unmated, rearward travel of plug connector 12 away from header connector 14 stops when nibs 95 of secondary latch 44 engagingly communicate with shoulders 93 adjacent secondary ramps 92. When connectors 12, 14 are partially unmated, the electrical connection between wire conductors 36*a*, 36*b* is electrically broken, while the power electrical signals on wire conductors 22, 30 are remain electrically connected in system 10. When partially unmated, blades 31 of fork-shaped terminal 29 are removed from terminals 39*a*, 39*b* so that the electrical connection of wire conductors 36*a*, 36*b* is electrically broken. Referring to FIGS. 7 and 8A, tool 62 is then employed to engage a portion of secondary latch 44 on underside surface 68 of secondary latch 44. Tool 62 is inserted into aperture 64 being guided by forward-sloping extending portion 79 of primary latch 42 and is used as a lever against secondary latch 44 and portion 79 provides the fulcrum for tool 62 to engage secondary latch 44, as best illustrated in FIG. 8B. The independent, cantilevered action of secondary latch 44 from primary latch 42 allows tool 62 to raise secondary latch 44 and lift nibs 95 of secondary latch 44 above shoulders 93 of secondary ramps 92 that allow release of secondary latch 44 from secondary ramps 92.

The slight backward tilting angle associated with shoulders 93 of secondary ramps 92 pulls connectors 12, 14 together slightly as secondary latch 44 is elevated. This action of pulling connectors 12, 14 slightly together along mating axis A of connectors 12, 14 causes nib 94 of primary latch 42 to climb upward along primary ramp portion 118 until nibs 95 of secondary latch 44 are about to be released and freed from abutting shoulders 93 of secondary ramps 92. As nib 94 of primary latch 42 slidingly engages external surface of ramp portion 118 of primary latch ramp 90, this provides a reaction force to push connectors 12, 14 apart along mating axis once nibs 95 of secondary latch 44 clear shoulders 93 of secondary latch ramps 92. As nibs 95 become free of shoulders 93 at each secondary latch ramp 92, an audible "snap" may be heard emanating from each secondary latch ramp 92 when each respective nib 95 is freed. When nibs 95 of secondary latch 44 are freed from abutment from shoulders 93, a portion of nibs 95 rest on the floor of apexes 116, as illustrated if FIG. 8B. This occurs because nib 94 of primary latch 42 continues to engagingly travel down external surface of primary latch ramp 90 and stops when a portion of nib 94 adjacent to the portion of nib 94 that previously abutted shoulder 91 engages the generally horizontal surface of connector body 17 that is parallel with axis A at the end of the ramp portion 118. Because the travel of nib 94 of primary latch 42 stops at this point, nibs 95 no longer travel and thus remain positioned on apexes 116 of secondary latch ramps 92. This action results in secondary latch 44 being disposed in the stationary elevated position from the neutral position as previously discussed where the angle of rotation Θ of the secondary latch 44 is at least in relation to the height of apexes 116 of secondary latch ramps 92.

Referring to FIG. 11, risk of overstressing secondary latch 44 with tool 62 is lessoned, or decreased with the assist of overstress tabs 66. When secondary latch 44 is clear of shoulders 93, plug connector 12 is releasable from header connector 14. Nib 94 of primary latch 42 rises over primary latch ramp 90 at a first time and nibs 95 of secondary latch 44 rise over secondary latch ramps 92 at a second time after the first time. The electrical connection of wire conductors 36*a*, 36*b* carrying control electrical signals are electrically broken at a point of time between the first time and the second time while the wire conductors 22, 30 remain electrically connected in system 10 when terminal 29 is unmated from terminals 39*a*, 39*b*. As a result of the electrical connection of wire conductors 36*a*, 36*b* being electrically broken, a time period commences where power electrical signals carried on wire conductors 22, 30 and terminals 28, 32 through system 10 ceases electrical transmission. This time period for the power electrical signals to cease transmission on wire conductors 22, 30 elapses before plug connector 12 may be completely unmated from header connector 14. The time period for the power electrical signals to cease transmission through system 10 is ensured before connectors 12, 14 are completely unmated due to the amount of time needed to insert tool 62 in aperture 64 and raise nibs 64 of secondary latch 44 above secondary latch ramps 92 so plug connector 12 is unmateable from header connector 14. Thus, this feature of electrical connection system 10 allows the power electrical signals to cease electrical transmission through system 10 before plug connector 12 is completely unmated from header connector 14. This feature provides enhanced safety for a service technician so that the power electrical signals do not electrically arc when plug connector 12 is unmated from header connector 14. If secondary latch 44 is actuated before primary latch 42, nib 94 of primary latch 42 engages shoulder 91 to prevent unmating of system 10.

Alternately, the electrical connection system may be used in any application that requires an electrical interface for electrical signal distribution and transmission from one location to another location and electrical connection system may electrically transmit any type of electrical signal. While the embodiment of FIGS. 1-15 show a plug and header connector, another embodiment may use free-standing, in-line electrical connectors where the connectors do not include at least one of the connectors being a mountable header connector. In another alternate embodiment, the electrical connection system may not be mounted to a case and in yet another alternate embodiment the electrical connection system may not include a flange. The electrical connection system may be useful in applications found in the motorized transportation, airline, and marine industries.

In the embodiment shown in FIGS. 1-15, there is one nib 95 in communication with one ramp 90 of primary latch 42 and two nibs 94 of secondary latch 44 associated with ramps 92. Ramps 90, 92 have the staggered zigzag arrangement as previously discussed herein. Alternately, the electrical connection system may be configured where the primary latch may have a U-shape and includes two nibs that communicate with two ramps and a secondary latch that includes one nib that communicates with a single ramp. The ramps in the alternate embodiment still have the staggered zigzag arrangement and the nibs of the primary and the secondary latches are still in alignment perpendicular to the mating axis similar to the embodiment of FIGS. 1-15. In yet another alternate embodiment, the ramps that communicate with the nibs on the respective primary and the secondary latches may be configured to be generally aligned along external surfaces of the header connector and the nibs disposed on the primary and the secondary latches are configured to have the staggered zigzag arrangement.

In still another alternate embodiment, any arrangement using any number of primary ramps, secondary ramps, and associated nibs in the electrical connection system to prevent electrical arcing of the power electrical signals when the electrical connection system is fully unmated is within the spirit and scope of this invention as described herein.

In a further alternate embodiment, the openings of the first and the second connector may have different complimentary shapes than what is described herein. Also the general shape of the first and the second connectors may have a different shape that is described herein.

Still yet alternately, the electrical connection system may employ one primary latch ramp and one secondary latch ramp that are axially and laterally spaced apart. In another embodiment, there may be one secondary latch ramp and a plurality of primary latch ramps that respectively axially and laterally spaced apart. The exact number of primary and secondary latch ramps and corresponding nibs that communicate with these latch ramps is dependent on the electrical signals that are transmitted through the electrical connection system. Preferably, when a plurality of primary latch ramps and a plurality of secondary latch ramps are used, the plurality of primary latch ramps are formed in one row disposed on the second connector and the plurality of secondary latch ramps are formed in a second row behind the plurality of primary latch ramps where the primary latch ramps and secondary latch ramps have a staggered arrangement as described previously herein.

In yet another alternate embodiment, the electrical connection system may include complementary terminal arrangements other than what is described herein. For example, the first connector may include male terminals and the second connector may include corresponding female terminals that mate with these male terminals.

In another alternate embodiment, the wire assemblies need mating compatibility such that wire assemblies mate together when the connectors in the power connection system are mated. For example, the wire assembly associated with the plug connector may be a male wire assembly and the wire assembly associated with the header connector may be a female wire assembly.

Thus, a reliable electrical connection system is easier to assemble as the connector body of the first connector is constructed of a single unitary piece. The electrical connection system is an electrical interface that may be utilized to route power electrical signals or other types of electrical signals through the electrical connection system from one location to another location. The first connector formed of a single unitary piece includes an integral primary and an integral secondary latch so that the primary and the secondary latch are not separate, distinct pieces that may otherwise undesirably increase the parts count needed to assemble an electrical connection system. The single unitary piece is molded using three different mold portions that define a cavity of the mold. Molding a single unitary piece may decrease molding manufacturing costs in contrast to molding the connector body, the primary latch, and the secondary latch as separate, distinct pieces. Also, the single unitary piece keeps otherwise loose-piece latch components from potentially becoming lost when the electrical connection system is disassembled during a repair to electrical components that communicate with the electrical connection system. If loose-piece latch components are lost, increased undesired service costs may result to repair the electrical connection system. If a non-integral first connector was constructed, loose-piece latch components may be undesirably omitted when the electrical connection system is re-assembled after a service repair is completed. The primary and the secondary latch communicate with distinct, dedicated latch ramps on the second connector to provide a more robust approach for high disengage force against inadvertent pull-outs of a mated first and second connector. Further, the integrated primary and integrated secondary latch may provide for more accurate tolerencing of the electrical connection system and ensure repeatable mating and unmating of the electrical connection system. The electrical connection system is easier for a human operator, or assembler to handle as the low profile, low relief tubular shape of the connector body of the first connector allows the first connector to be routed through smaller holes in a vehicle body when assembling the electrical connection system in a vehicle during vehicle assembly. The primary and the secondary latch are conveniently positioned in axial proximity along a common portion of the connector body along an axial length of the connector body of the first connector. This allows for easier accessibility to both the primary and the secondary latch and also further achieves a low-profile connector body. The first connector includes the latch position assurance lock that may be installed in a lock position after the first connector is mated to the second connector to prevent unintended, or inadvertent actuation of the primary latch. The latch position assurance lock keeps a service technician from prematurely partially unmating the electrical connection system before being ready to do so. The electrical connection system has increased robustness in that the latch position assurance lock allows the first connector to unmate from the second connector when the latch position assurance lock is intentionally physically removed from the space underlying the primary latch. Further, after the latch position assurance lock is initially attached to a track on the connector body of the plug connector, the latch position assurance lock includes provisions to engage with provisions of the connector body of the plug connector to prevent unintentional removal of the latch position assurance lock from the connector body. This feature is useful to keep the latch position assurance lock from becoming undesirably misplaced or lost when the first connector is unmated from the second connector. The attached latch position assurance lock is conveniently re-used when the first connector is re-mated with the second connector. An overstress feature disposed on the secondary latch prevents potential damage to the secondary latch if too much pressure is applied by the tool to the secondary latch which may assist to reduce service costs to the first connector. The electrical connection system is constructed so that the electrical connection of the wire conductors carrying the control electrical signals are electrically broken when the electrical connection system is partially unmated so that the power electrical signals carried on other wire conductors in the electrical connection system cease electrical transmission before a time delay associated with the electrical connection system elapses when the first and the second connector are completely unmated. A force to activate the primary latch is easily applied with depression of the primary latch. The force may be applied with a flat of a finger of a human hand regardless of the size of the finger. The secondary latch being urged and maintained at a stationary elevated position is effective to allow the first and the second connector of the electrical connection system to be fully unmated from the partially unmated position using only a single human hand of a human assembler or service technician. This feature is especially advantageous when the electrical connection system is disposed in a tight, or cramped space or location in an application where access to the electrical connection system is limited.

While this invention has been described in terms of the preferred embodiment thereof, it is not intended to be so limited, but rather only to the extent set forth in the claims that follow.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiments, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. An electrical connection system comprising:

a mating axis; and a first connector axially matable to a second connector, wherein said first connector includes a connector body and a primary latch and a secondary latch having an axially spaced relationship with the primary latch along an axial length of the connector body in which at least the primary latch is further in communication with, and outwardly spaced apart from the connector body to define an open-ended space therebetween, and the primary and the secondary latch are constructed integrally with the connector body so that the connector body is formed as a single unitary piece, the space being adapted to fit a latch position assurance lock so that when said latch position assurance lock is fitted in to the space, the latch position assurance lock prevents displacement of the primary latch.

2. The electrical connection system according to claim 1, wherein said latch position assurance lock is attached to the connector body of the first connector and is moveable between a lock position and an unlock position disposed remote from the lock position, said latch position assurance lock being disposed in the space of the first connector when in the locked position so as to prevent displacement of the primary latch with actuation thereon, and said latch position assurance lock is removeable from the space being moved to the unlock position to thereby allow displacement of the primary latch with actuation thereon.

3. The electrical connection system according to claim 2, wherein said latch position assurance lock is disposed in the unlock position and the primary latch is actuated by a force applied in a direction towards the connector body of the first connector to lift a portion of the primary latch over at least one ramp disposed on the second connector, and the secondary latch is actuated by being engaged with a tool, said tool being operated as a lever to raise a portion of the secondary latch away from the connector body of the first connector over at least one ramp disposed on the second connector that is different from the at least one ramp associated with the primary latch.

4. The electrical connection system according to claim 3, wherein the secondary latch comprises an overstress feature to prevent overstress to the secondary latch from engagement with the tool, said overstress feature comprising at least one tab disposed adjacent a main section of the secondary latch.

5. The electrical connection system according to claim 1, wherein the primary and the secondary latch, respectively, are disposed intermediate common rails, and the latches are respectively integrally attached to the common rails, said common rails being integrally attached to the connector body of the first connector.

6. The electrical connection system according to claim 1, wherein the electrical connection system comprises wire conductors for carrying a first set of electrical signals and wire conductors for carrying a second set of electrical signals that are controlled by said first set of electrical signals, and actuation of the latches, respectively, includes the primary latch being lifted over at least one ramp disposed on the second connector at a first time period and the secondary latch being lifted over at least one ramp disposed on the second connector at a second time period that is different from the at least one ramp associated with the primary latch, and at a time period disposed between the first time period and the second time period the wire conductors carrying the first set of electrical signals are electrically disconnected within the electrical connection system while the wire conductors carrying the second set of electrical signals remain electrically connected therein.

7. The electrical connection system according to claim 1, wherein the second connector includes a connector body having an external surface containing at least one primary latch ramp and at least one secondary latch ramp, and the primary latch is in communication with the at least one primary latch ramp and the secondary latch is in communication with at least one secondary latch ramp at least when the first connector is unmated from the second connector.

8. The electrical connection system according to claim 7, wherein said at least one secondary latch ramp is disposed axially aft of said primary latch ramp in a direction of the connectors being unmated, said at least one secondary latch ramp includes a pair of laterally-spaced secondary latch ramps.

9. The electrical connection system according to claim 1, wherein a plane is defined along an external surface of the primary latch and an external surface of the secondary latch such that the primary and the secondary latch are generally disposed in the plane.

10. The electrical connection system according to claim 9, wherein when a tool engages the secondary latch the tool urges the secondary latch from a neutral position to a stationary elevated position so that at least a portion of the secondary latch extends above the plane in a direction generally perpendicular to the axis, said secondary latch being disposed in said stationary elevated position having an angle of rotation with respect to said plane.

11. The electrical connection system according to claim 10, wherein said angle of rotation is in relation to at least a portion of the primary latch resting on at least one ramp disposed on the second connector and at least a portion of the secondary latch resting on at least one ramp disposed on the second connector that is different from the at least one ramp associated with the primary latch.

12. A method to assemble an electrical connection system comprising:

receiving a connector body of a first connector body into a connector body of a second connector along a mating axis, the connector body of the first connector including wire conductors attached to terminals and the connector body of the second connector including wire conductors attached to terminals, and the connector body of the first connector includes a primary latch and a secondary latch axially spaced apart from the primary latch along an axial length of the connector body, and the primary latch, the secondary latch and the connector body of the first connector are formed as a single unitary piece, the primary latch being spaced apart from the connector body in a direction transverse to the axis to define a space adapted to fit a latch position assurance lock.

13. The method according to claim 12, wherein the method further includes, securing said latch position assurance lock to the first connector so that said latch position assurance lock is axially aligned with the space.

14. The method according to claim 13, further including, moveably urging said secured latch position assurance lock in to the space to a lock position so that said latch position assurance lock has an underlying, adjacent relationship with the primary latch to prevent displacement thereto.

15. The method according to claim 14, further including, removeably urging said latch position assurance lock away from the space to an unlock position remote from the lock position, and actuating the primary latch to displace the primary latch.

16. The method according to claim 15, further including, partially unmating the first connector from the second connector, and actuating the secondary latch using a tool to displace the secondary latch, wherein the steps of actuating the primary latch and the step of actuating the secondary latch further include the connector body of the second connector having ramps comprising at least one primary latch ramp and at least one secondary latch ramp, the primary latch being in communication with the at least one primary latch ramp and the secondary latch being in communication with the at least one secondary latch ramp at least when the first connector is unmated from the second connector.

17. The method according to claim 16, wherein the step of actuating the secondary latch using the tool further includes, urging, with the tool, the secondary latch to a stationary elevated position from the neutral position such that the secondary latch has an angle of rotation in relation to at least one nib disposed on the secondary latch resting on at least a portion of at least one secondary latch ramp.

18. The method according to claim 12, wherein the step of receiving the connector body further includes the primary and the secondary latch, respectively, having an intermediate, integrally attached relationship to common rails that are further integrally attached to the connector body of the first connector.

19. The method according to claim 12, wherein the step of receiving the connector body further includes the primary and the secondary latch comprising cantilevered action so that when respectfully actuated, the cantilevered action of the primary latch is independent of the cantilevered action of the secondary latch.

20. The method according to claim 12, wherein the step in the method further includes a plane being defined along an external surface of the primary latch and an external surface of the secondary latch such that the primary latch and the secondary latch are also generally disposed in said plane.

21. An electrical connection system comprising:

a mating axis; and a first connector axially matable to a second connector, said first connector including a connector body having a primary and a secondary latch where at least the primary latch is spaced apart from the connector body to define a space, and the primary and the secondary latch are molded integrally with the connector body so that the connector body is formed of a single unitary piece, the single unitary piece being formed in a mold that includes a primary axial mold portion, a secondary axial mold portion, and an orthogonal slide mold portion where the mold portions collectively combine in a mold arrangement to define a mold cavity, and the secondary mold portion is adapted to axially engage the primary mold portion and the slide mold portion is adapted to engage and overlie at least a portion of the primary mold portion and a portion of the secondary mold portion, and the connector body is molded in the mold cavity by virtue of external surfaces of the primary and the secondary latch that face the connector body being molded so that there is no overlap as seen in an axial direction, and the slide mold portion is adapted to mold at least the respective external surfaces of the primary and the secondary latch facing away from the connector body, and at least one of the axial mold portions includes a raised mold element, wherein when the respective mold portions are separated to release the molded connector body from the cavity, said molded connector body is at least axially withdrawn from the mold element so that the mold element relinquishes the space such that the space is adapted to fit a latch position assurance lock that underlies the primary latch.

* * * * *